US005259528A

United States Patent [19]

Pace et al.

[11] Patent Number: 5,259,528

[45] Date of Patent: Nov. 9, 1993

[54] COMBINATION FOOD, DRINK, UTENSIL AND NAPKIN TRAY

[76] Inventors: Michael A. Pace, 3320 Old Point Rd., Edgewater, Md. 21037; Mark Girovich, 13 Suntop Ct., Unit 302, Baltimore, Md. 21209

[21] Appl. No.: 46,264

[22] Filed: Apr. 6, 1993

[51] Int. Cl.[5] ..... B65D 1/36

[52] U.S. Cl. ..... 220/575; 220/23.83; 220/23.8; 206/561; 206/562; 206/557

[58] Field of Search ..... 220/575, 574, 23.83, 220/23.8; 206/561, 562, 557, 587, 563, 564, 1.7

[56] References Cited

U.S. PATENT DOCUMENTS

| | | | |
|---|---|---|---|
| 211,532 | 6/1968 | Ashton . | |
| 301,820 | 6/1989 | Wasserman . | |
| 1,272,996 | 7/1918 | Poschadel | 220/575 |
| 2,240,020 | 4/1941 | Raiser . | |
| 2,677,350 | 5/1954 | Presidge et al. | 220/575 |
| 2,709,904 | 6/1955 | Boughton | 220/575 |
| 3,498,470 | 3/1970 | Thomas . | |
| 3,955,672 | 5/1976 | Brundage . | |
| 4,732,274 | 3/1988 | Bouton . | |
| 4,823,958 | 4/1989 | Mahmud . | |
| 4,852,738 | 8/1989 | Craig et al. | 220/575 |
| 4,867,331 | 9/1989 | Task . | |
| 4,966,297 | 10/1990 | Doty . | |
| 5,119,967 | 6/1992 | Ercolani . | |

*Primary Examiner*—Joseph Man-Fu Moy

*Attorney, Agent, or Firm*—Fay, Sharpe, Beall, Fagan, Minnich & McKee

[57] ABSTRACT

A stackable combination party tray for food, drink, utensils and napkins has a flat rectangular platform with two or more recessed food compartments, surrounded by an upturned peripheral retaining lip, one recessed compartment for holding a plurality of sizes of beverage containers, one recessed compartment for holding utensils and one recessed compartment for holding a napkin. These three compartments are each of the same depth and have flat bottom surfaces to provide three points of support for permitting the tray to be supported on a support surface. The beverage container compartment extends a distance below the bottom surface of the rectangular platform a distance sufficient to allow a person's hand to grip the tray. Thus, one's tray and drink can be held in one hand.

4 Claims, 2 Drawing Sheets

COMBINATION FOOD, DRINK, UTENSIL AND NAPKIN TRAY

BACKGROUND OF THE INVENTION

1. Field of the Invention

The invention relates to the serving of food and drink on a tray and, more specifically, to a combination tray for containing food, a beverage container, utensils and a napkin that can be easily held in one hand and stably supported on a flat surface.

2. Description of the Prior Art

One example of a device for holding food, drinks and utensils is shown in U.S. Pat. No. 4,867,331 to Task. This device and others like it have not successfully addressed the problem of providing a combination tray that is easily gripped with one hand for carrying the tray and stably supported once set down on a support surface.

SUMMARY OF THE INVENTION

The invention provides a combination beverage container, food and utensil tray that can be stored or shipped in a nested stack. The trays are used for serving a beverage container with food at social events, for example. In such events, one typically needs to carry a beverage container, plate of food and utensils, including a napkin, while standing around or moving between an area where the food and beverages are being served to another area where people are socializing. During the socializing, it is frequently expedient to have one hand free for greeting others and eating. Ordinarily, a beverage container is held in one hand while a plate of food is held in the other, thus making greetings and eating difficult without setting one of the beverage or food plate down.

By the present invention, a combination tray is provided to contain a beverage container as well as provide a plate for food and a receptacle for utensils and a napkin. The beverage receptacle that contains the beverage has a depth sufficient to enable the outer periphery of the receptacle to be gripped for carrying the tray. Thus, one's food and beverage, as well as utensils and napkin can be carried comfortably in one hand leaving the other hand to eat with and greet others.

According to another object of the present invention, the combination tray is constructed not only for being easily gripped in one hand, but also for being stably supported once set down on a support surface.

According to yet another object of the present invention, the receptacle or compartment for containing a beverage has protrusions that extend inwardly into the receptacle for positioning a beverage by flexibly yielding as the beverage cup or other container is inserted in the receptacle. The protrusions are positioned to provide a wedging and spring-like action against the beverage cup or container inserted in the receptacle to maintain it in a position against one wall of the compartment. This prevents the container from shifting in the receptacle and also provides a firm support against which one's hand can be wrapped when carrying the tray.

The combination beverage tray of the present invention has a plurality of utensil or napkin receptacles, in addition to the beverage container receptacle. Each of the beverage container receptacle and utensil receptacles has a flat bottom for resting on a support surface. Preferably, the utensil receptacles are positioned in a triangular arrangement with respect to the beverage container receptacle to provide a three-point support of the tray when the tray is set down on a support surface.

The expanse of the tray that is usable for containing food has an outer upstanding rim to contain the food. The utensil/napkin receptacles are provided at the corners of the tray. In a preferred embodiment, the tray is pentagon shaped with the utensil/napkin receptacles being provided at two corners of the pentagon opposite the beverage container receptacle. This provides the desired three-point or tripod support of the tray when the tray is set down on a support surface.

BRIEF DESCRIPTION OF THE PREFERRED EMBODIMENT

DETAILED DESCRIPTION OF THE PREFERRED EMBODIMENTS

Figure 1:
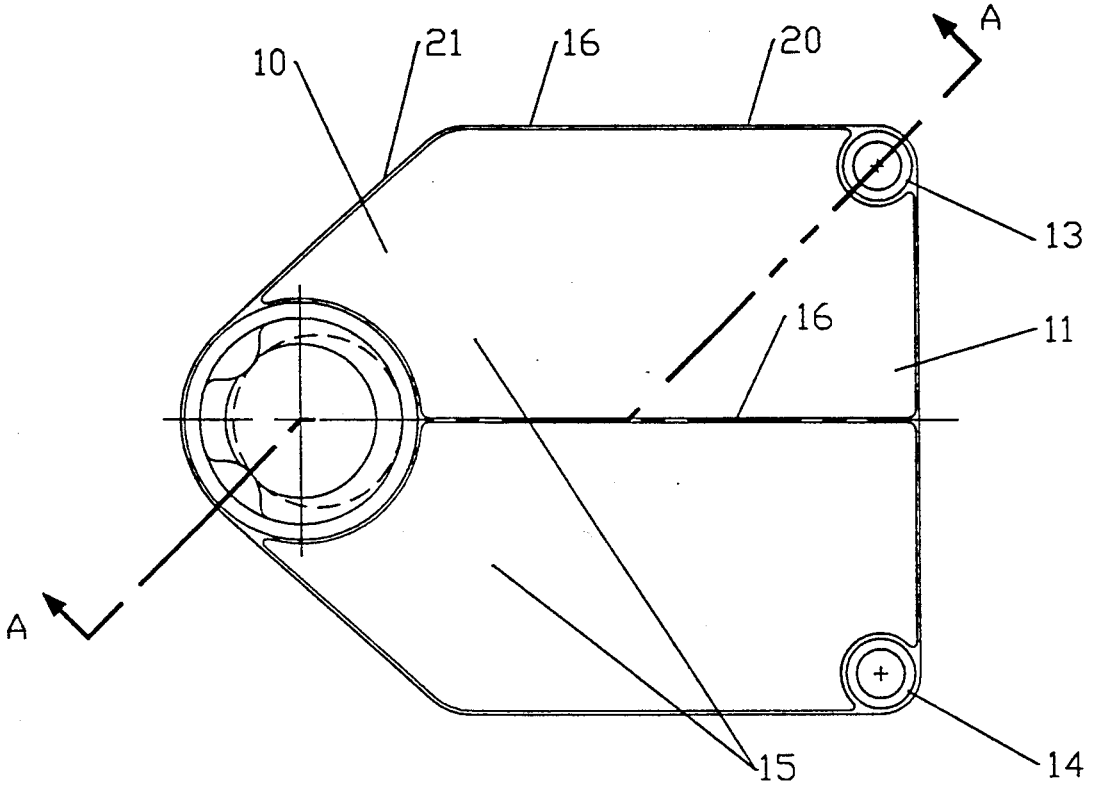
FIG. 1 is a top plan view of a combination tray constructed according to the present invention.

Tray 10 has a generally pentangular shape with a first portion 20 being essentially square and a second portion 2 being essentially triangular. Preferably, the tray is of unitary molded construction so that it can be manufactured in one piece.

At the outside corners of the square portion 20 of the tray 10 are utensil or napkin receptacles 13, 14. At the outside corner of the triangular portion 21 is a beverage container receptacle 12, which is preferably tapered in shape with an opening of 3" to 3½". Each of the receptacles has an essentially flat bottom portion suitable for resting on a support surface when the tray is set down. The flat bottom surface may extend around the periphery of the bottom wall of the receptacles or the entire bottom wall of the receptacle may be made flat, as desired. To provide for nested stacking, each of the receptacles flares outwardly, which also provides for mold relief, as needed.

As shown in FIG. 1, each of receptacles 13 and 14 are of the same size. In a modification, not shown, receptacles 13 and 14 may be sized differently, as desired. The significant aspect of the receptacles 13, 14 is that they are suitable for containing utensils or napkins and the like, and that they are spaced apart a distance from each other and with respect to receptacle 12 a distance sufficient to provide stability of the tray once it is set down.

Figure 2:
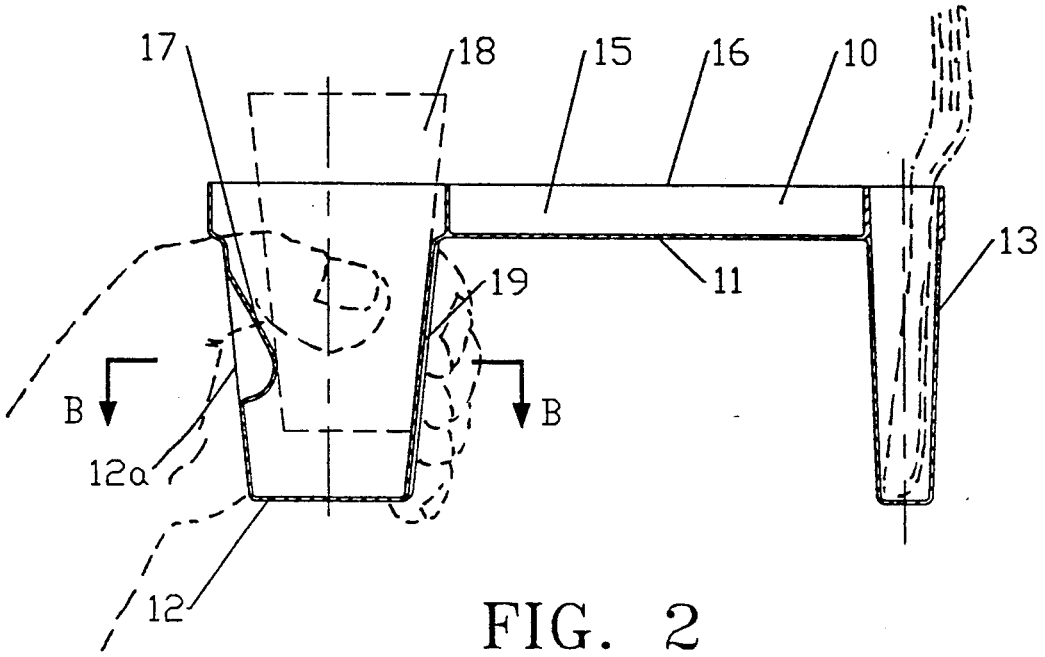
FIG. 2 is a side elevation of the tray showing a hand gripping the beverage container receptacle and taken along lines A—A of FIG. 1.

As shown in FIGS. 1 and 2, the tray has food compartments 15, divided by a lip or upstanding flange 16, which also extends around the outer periphery of the food compartments. The lip is essentially vertical with respect to the platform 11 of the tray, but tapering for nesting and mold relief is provided in accordance with conventional practice. The separating portion of flange 16 between food compartments 15 also provides stability for the tray, but may be removed and replaced by a rib if it is desired that the tray have only one large open food compartment. Additional ribbing, for example, shown at 19 in FIG. 2, can be provided to provide strength and rigidity of the tray. Alternatively, more than two food compartments can be provided, as desired.

Figure 3:
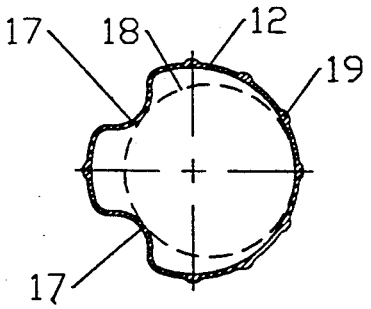
FIG. 3 is a cross-sectional view of the beverage container receptacle taken along lines B—B in FIG. 2.

As shown in FIG. 3, the beverage container receptacle has preferably two protrusions 17 that are tearshaped. The effect of these protrusions is to cam or wedge a beverage container, such as a cup or bottle toward the opposite side of the receptacle side wall 12A from which the protrusions 17 extend. Further, the protrusions are sufficiently resilient to provide a spring-like action that helps to retain the beverage container within the receptacle, abutting the receptacle wall. This means that not every beverage container engages the bottom of receptacle 12, but may merely be wedged into place part way down into the receptacle. This assists the user in gripping the outer periphery of the beverage container receptacle 12 and provides a reassuring feeling of stability when the tray is grabbed with the hand, as shown in FIG. 2. As a modification, only one such protrusion could be provided, but two protrusions are shown as the preferred embodiment.

As shown in FIG. 2, the tray is grasped by a user's hand around receptacle 12. To accommodate the user's hand, the depth of receptacle 12 is preferably 2½" to 3½" deep or about ⅔ the depth dimension of an 8–16 oz. cup. This permits a cup to extend up above the lip of the receptacle for easy removal. This permits one to have as much hand control of the beverage container as one would if just holding the beverage container by itself, in order to prevent spillage. At the other end of the tray 15, on the other hand, receptacles 13 and 14 are intended to hold utensils, condiments, napkins and the like which are not subject to spillage. Even accidental tipping of the tray is not likely to result in spillage of the beverage. This makes using the tray very convenient and reassuring since ordinary movements of the tray can be made in the same manner as if only the beverage container were being held in the hand.

Although the tray is intended to be held in one hand thus enabling the other hand to be free for use in eating the food from the tray or greeting another person, etc., it is necessary to set the tray down at times to permit both hands to be free. The three receptacles combine to provide a stable three-point support structure that ensures the tray will not be easily tipped once set down. Also, the spacing of the receptacles 13 and 14 from the receptacle 12 ensures that the user can easily reach his hand underneath and around receptacle 12 to grip the tray without interference from the receptacles 13 and 14. Additionally, since the user grips the beverage container receptacle, hot foods can be placed in the food compartment 15 without risking the burning of the user's hand as he grips the tray.

As shown in FIG. 2, the receptacles 13 and 14 are of the same depth as receptacle 12 and at least of a depth sufficient to hold about three fifths, or at least better than half of a typical plastic utensil, such as a fork, knife or spoon. If it is desired, however, to use one of the receptacles 13 and 14 for a dip container or condiment container, a suitably sized container could easily fit into the opening of the receptacle without extending to the bottom of the receptacle. Alternatively, a series of protrusions, like those provided for receptacle 12 could be included in the construction of receptacles 13 and 14. Furthermore, additionally receptacles of shallower depth can be provided at other locations within the food compartment 15. Preferably, such receptacles would be within the bounds of the lines joining the three receptacles 12, 13 and 14 in order to prevent tipping of the tray once it is set down, but preferably also the additional receptacles would be positioned far enough away from receptacle 12 so that interference is not caused when the user attempts to grip the receptacle with the hand, as shown in FIG. 2.

According to the present invention, it is desired that the tray be constructed of a hard plastic able to withstand the bending forces created when food is added to the food compartments and the tray is held by one hand from the receptacles 12. Additionally, ribs extending outwardly from the receptacle 12 to the receptacles 13, 14 and along the flange 16 dividing the food compartments would provide greater strength and rigidity for the tray. Such modifications and other modifications not herein specifically provided for are considered to be a part of the invention, as defined by the claims.

We claim:

1. A combination beverage container supporting and food containing tray, comprising a platform having a food compartment with an upstanding flange surrounding the compartment;

first, second and third receptacles connected with and extending below said food compartment;

said second and third receptacles being smaller than said first receptacle and being spaced apart from said first receptacle and apart from each other, said receptacles having a flat bottom portion and a common depth such that said tray is supported by said three receptacles when set down on a support surface;

said first receptacle having an opening of approximately 3.0–3.5– and being tapered for receiving a beverage container of varying size, and said first receptacle having an outer periphery below said food compartments providing a hand grip for a user of the tray.

2. A tray according to claim 1, further comprising:

first receptacle having at least two protrusions extending outwardly from a wall of said receptacle to position a beverage container inserted into said receptacle toward a wall opposite the wall from which said protrusions extend; and said protrusions being yieldable for pressing a beverage container contained within said receptacle against said wall portion to maintain contact between the beverage container and the beverage container receptacle so that when the outer periphery of the beverage container receptacle is gripped by a user, a beverage container is stably supported within the beverage container receptacle.

3. A tray according to claim 1, wherein said second and third receptacles are of the same size and respectively receive one of a napkin, fork, spoon and knife.

4. A tray according to claim 1, wherein said food compartment is divided by an upstanding flange that is part of said flange extending about the periphery of said food compartment.

* * * * *